US009247776B1

(12) United States Patent
Kim

(10) Patent No.: US 9,247,776 B1
(45) Date of Patent: Feb. 2, 2016

(54) GARMENT POCKET FOR MOBILE PHONE

(71) Applicant: Yong Chong Kim, Los Angeles, CA (US)

(72) Inventor: Yong Chong Kim, Los Angeles, CA (US)

( * ) Notice: Subject to any disclaimer, the term of this patent is extended or adjusted under 35 U.S.C. 154(b) by 0 days.

(21) Appl. No.: 14/585,757

(22) Filed: Dec. 30, 2014

(51) Int. Cl.
*A41D 27/20* (2006.01)

(52) U.S. Cl.
CPC ..... *A41D 27/205* (2013.01); *A41D 27/201* (2013.01)

(58) Field of Classification Search
CPC ..... A41D 1/02; A41D 13/0012; A41D 27/20; A41D 13/02; A41D 1/06; A41D 3/00; A41D 1/00
USPC ..... 2/93, 94, 247, 250, 253, 79, 227, 108, 2/115
See application file for complete search history.

(56) References Cited

U.S. PATENT DOCUMENTS

| | | | | | |
|---|---|---|---|---|---|
| 1,257,048 | A * | 2/1918 | Tamas | 2/253 |
| 2,407,888 | A * | 9/1946 | Lesser | 2/253 |
| 2,967,307 | A * | 1/1961 | O'Donnell | 2/253 |
| 4,791,681 | A * | 12/1988 | Dean | 2/106 |
| 5,509,147 | A * | 4/1996 | Busquets | 2/253 |
| 5,884,338 | A * | 3/1999 | Golde | 2/247 |
| 7,165,271 | B2 * | 1/2007 | Elen | 2/85 |
| 7,637,218 | B1 * | 12/2009 | Burton | 108/43 |
| 7,908,675 | B2 * | 3/2011 | Robinson | 2/247 |
| 8,032,948 | B2 * | 10/2011 | Anderson | 2/69 |
| 8,453,896 | B1 * | 6/2013 | Mansell | 224/576 |

* cited by examiner

*Primary Examiner* — Tejash Patel
(74) *Attorney, Agent, or Firm* — East West Law Group; Heedong Chae

(57) ABSTRACT

A pocket for a garment includes a first pocket fixedly attached to the garment at a predetermined location wherein a first opening is formed on the garment and the first pocket is fixedly attached to a rim of the first opening such that the first pocket is accessible through the first opening, and a second pocket fixedly attached to the first pocket wherein a second opening is formed on the first pocket such that the second pocket is accessible through the second opening. The first pocket is to carry items such as a cell phone, smart phone or mobile phone and the second pocket is generally to carry smaller items.

10 Claims, 25 Drawing Sheets

GARMENT POCKET FOR MOBILE PHONE

CROSS-REFERENCE TO RELATED APPLICATIONS

Not applicable.

FIELD OF THE INVENTION

The present invention relates to a pocket for a garment for carrying having personal items such as a mobile phone. The present invention further includes a backpack for a garment which is attached to a back of the garment.

SUMMARY OF THE INVENTION

The present invention provides a pocket for a garment for carrying having personal items such as a mobile phone, smart phone or cell phone. A smart phone is generally getting bigger and bigger and there has been a need for a pocket to carry such a big smart phone.

The object of the present invention is to provide a pocket for a garment, which includes a first pocket fixedly attached to the garment at a predetermined location wherein a first opening is formed on the garment and the first pocket is fixedly attached to a rim of the first opening such that the first pocket is accessible through the first opening; and a second pocket fixedly attached to the first pocket wherein a second opening is formed on the first pocket such that the second pocket is accessible through the second opening.

Another object of the present invention is to provide a pocket for a garment, which includes a first pocket, fixedly attached to the garment at a first predetermined location, and a second pocket, fixedly attached to the garment at a second predetermined location. The first pocket has a first opening wherein the first pocket is accessible through the first opening and the second pocket has a second opening wherein the second pocket is accessible through the second opening. The pocket further includes a first closure means to open or close the first opening and a second closure means to open or close the 15 second opening. The first pocket is formed by sewing a first fabric to the garment along the first fabric's edges to the garment, and the second pocket is formed by sewing a second fabric to the garment along the second fabric's edges to the garment.

Still another object of the present invention is to provide a backpack for a garment, which includes a garment opening means formed on a back of the garment to open or close a garment opening; and a backpack attached to an inner side of the back of the garment by a backpack attachment means. The backpack further comprises a backpack opening means to open or close the backpack and the backpack is configured to be able to be pulled out through the garment opening after the garment opening means is open.

The advantages of the present invention are: (1) the present invention provides a pocket for a garment to carry a large item such as a mobile phone or smart phone; (2) the present invention is easy to manufacture and use; (3) the structure of the present invention is pleasing in appearance and functionally superior; (4) the pocket of the present invention is convenient to receive a mobile phone therein; and (5) the backpack of the present invention is detachable or hidden from view if not in use.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 1(*b*) shows a rear view of the pocket for a garment of FIG. 1(*a*) where the first pocket is open;

FIG. 1(*c*) shows a rear view of a pocket for a garment according to another embodiment of the present invention where the first pocket is open;

FIG. 3(*b*) shows the pocket of FIG. 1(*c*) fixedly attached to a rear upper edge of a garment;

FIG. 3(*c*) shows the pocket of FIG. 1(*c*) fixedly attached to a side upper edge of a garment;

FIG. 3(*d*) shows the pocket of FIG. 1(*c*) fixedly attached to a front upper edge of a garment where the first pocket is open;

FIG. 4(*b*) shows a pocket for a garment fixedly attached to a garment such as a shirt according to still another embodiment of the present invention;

FIG. 6(*b*) shows a pocket for a garment fixedly attached to a garment such as a dress according to still another embodiment of the present invention;

FIG. 6(*c*) shows pockets for a garment fixedly attached to a garment such as a shirt according to still another embodiment of the present invention;

FIG. 7(*b*) shows the backpack for a garment of FIG. 7(*a*) where the garment opening means is open;

FIG. 7(*c*) shows the backpack for a garment of FIG. 7(*a*) where the backpack is pulled out through the garment opening means;

FIG. 8(*b*) shows the backpack for a garment of FIG. 8(*a*) where the backpack is put inside through the garment opening means;

FIG. 10(*b*) shows a side view of the pocket of FIG. 10(*a*) wherein the pocket is flipped to the left;

FIG. 10(*c*) shows a side view of the pocket according to still another embodiment of the present invention;

FIG. 10(*d*) shows a side view of the pocket of FIG. 10(*c*) wherein the pocket is flipped downward;

FIG. 11(*b*) shows a side view of the pocket of FIG. 11(*a*) wherein the inner pocket is open.

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

The present invention relates to a pocket 10 for a garment 100 for carrying having personal items such as a mobile phone 80. The present invention further includes a backpack 50 for a garment 100 which is attached to a back of the garment 100.

Figure 1A:
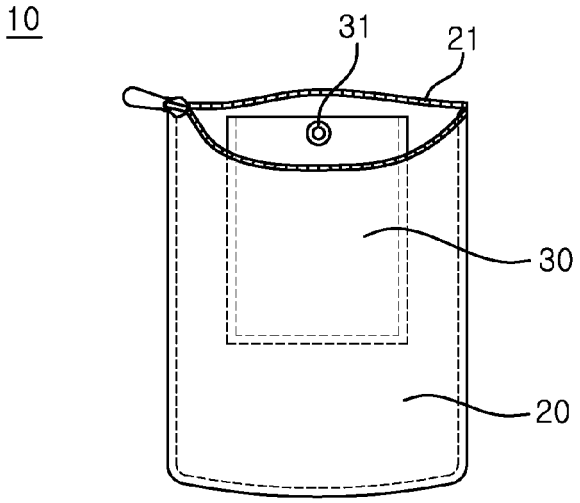
FIG. 1(*a*) shows a front view of a pocket for a garment according to one embodiment of the present invention.
Figure 1B:
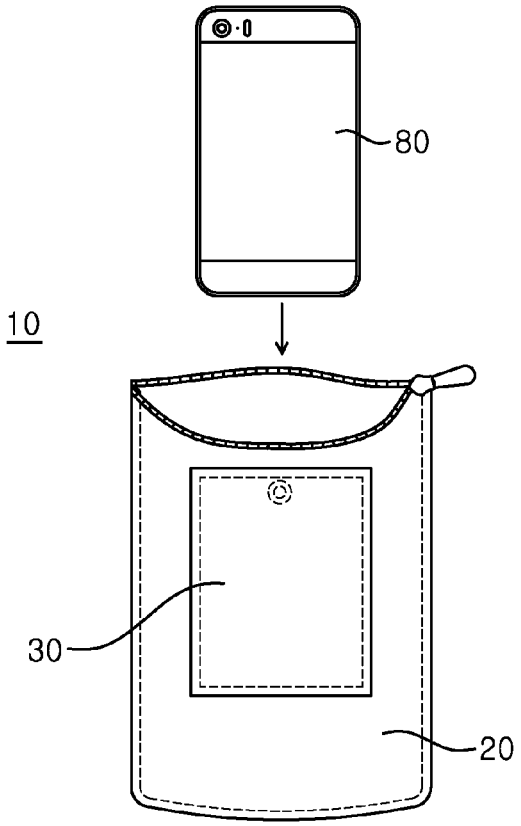
Figure 1C:
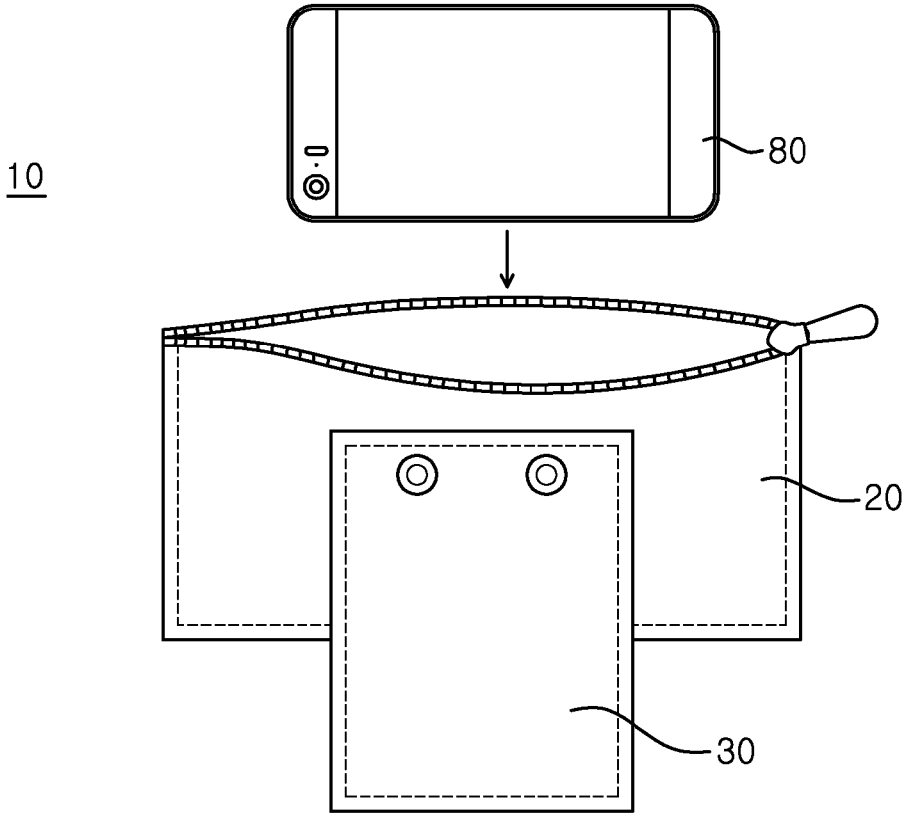
Figure 2:
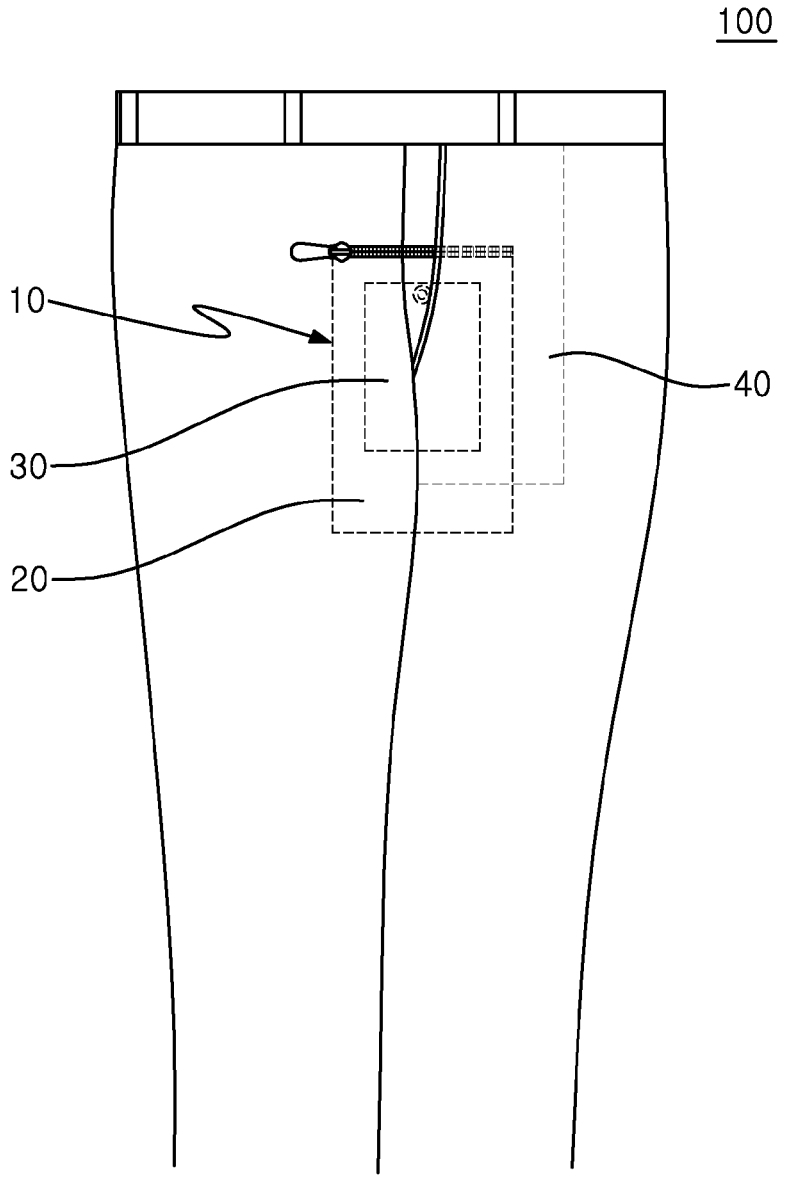
FIG. 2 shows a front view of the pocket for a garment of FIG. 1(*a*) fixedly attached to a side of a garment.
Figure 3A:
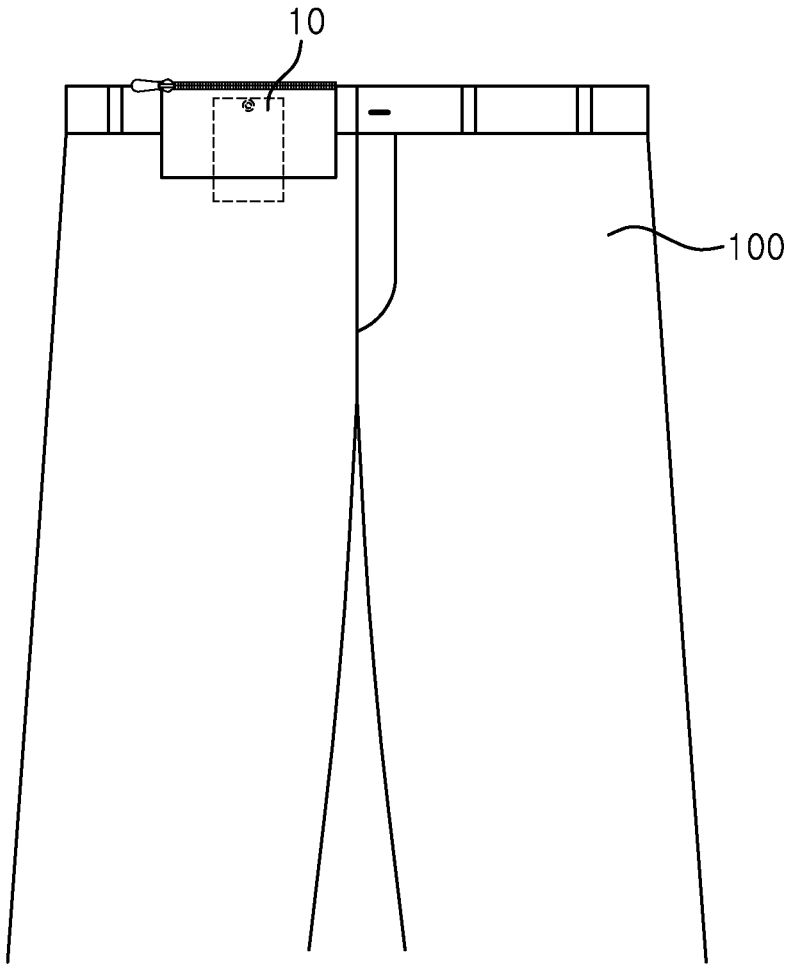
FIG. 3(*a*) shows the pocket of FIG. 1(*c*) fixedly attached to a front upper edge of a garment.
Figure 3B:
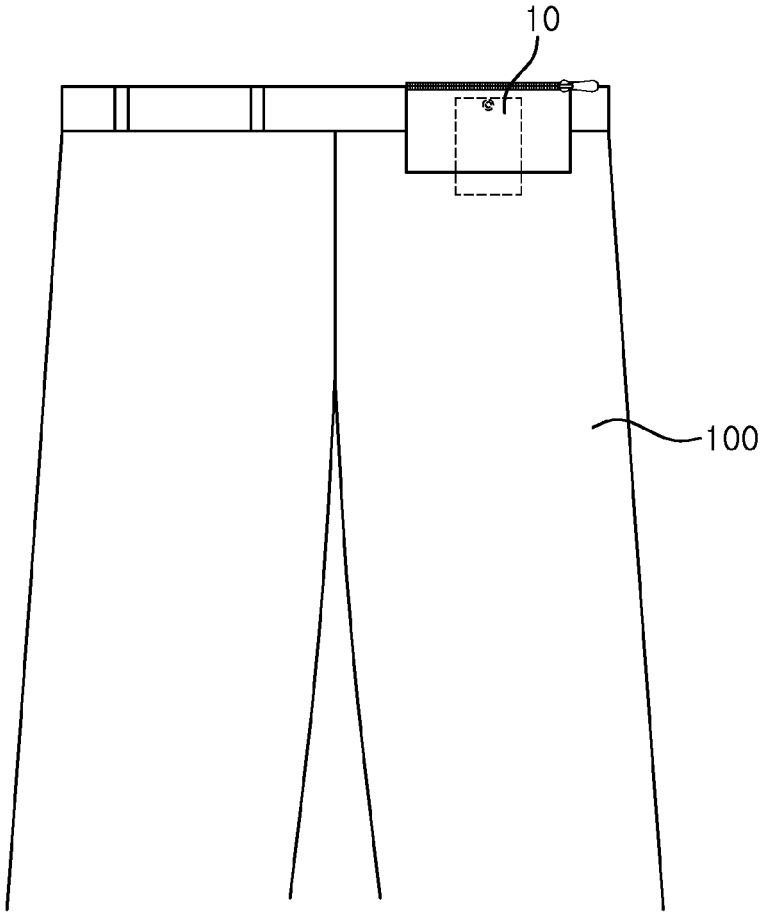
Figure 3C:
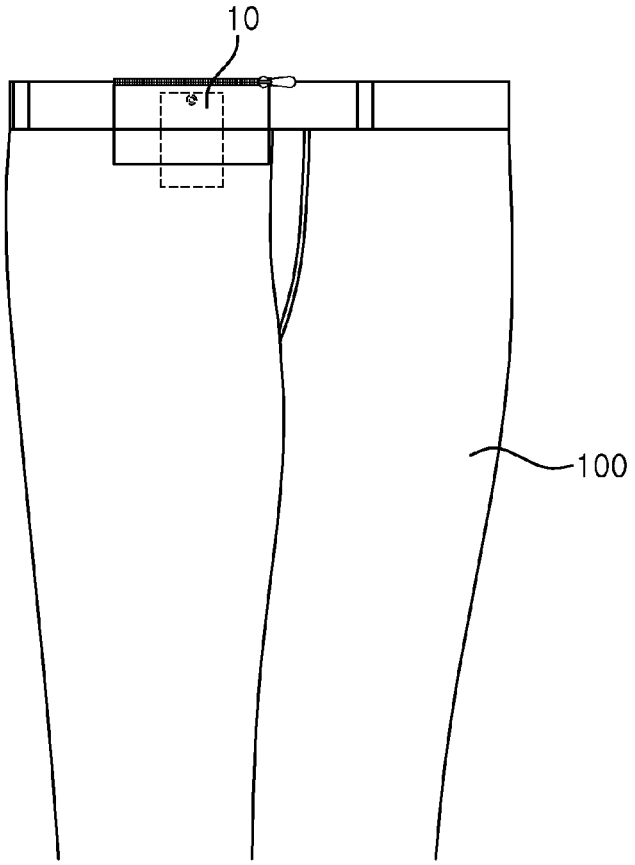
Figure 3D:
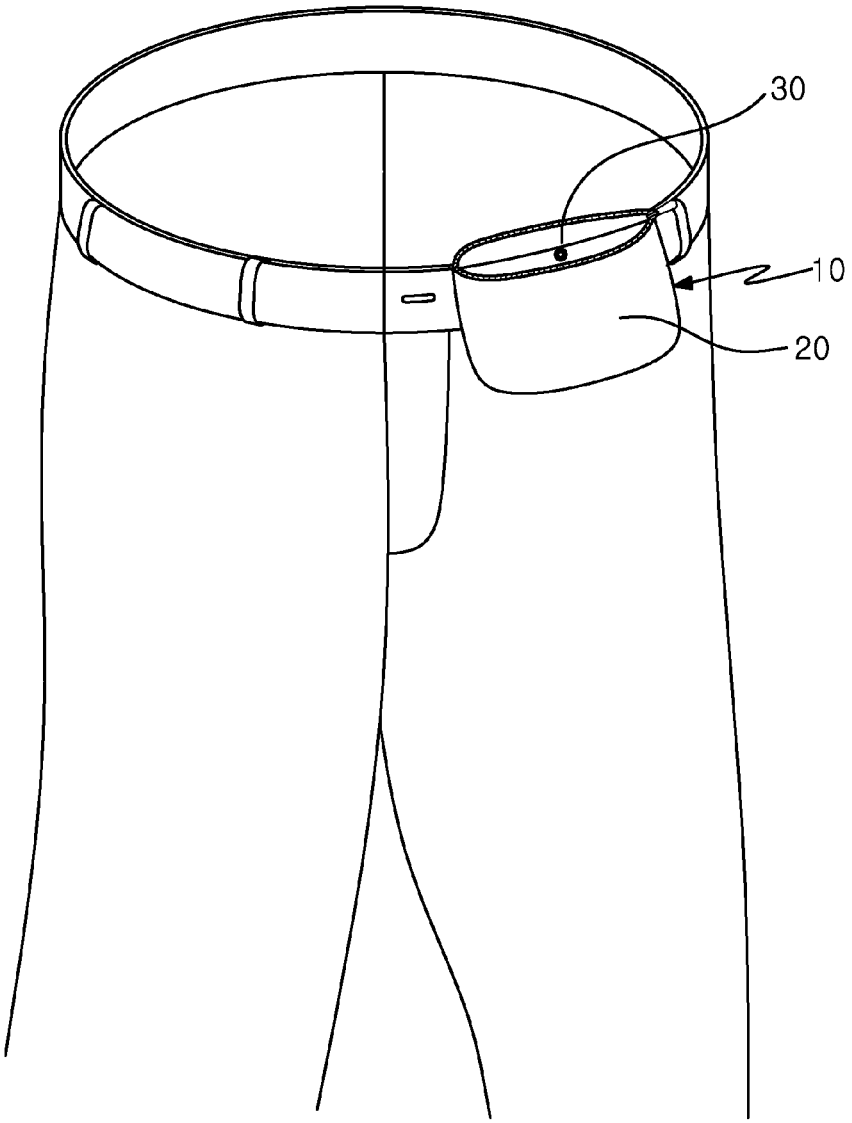
Figure 9:
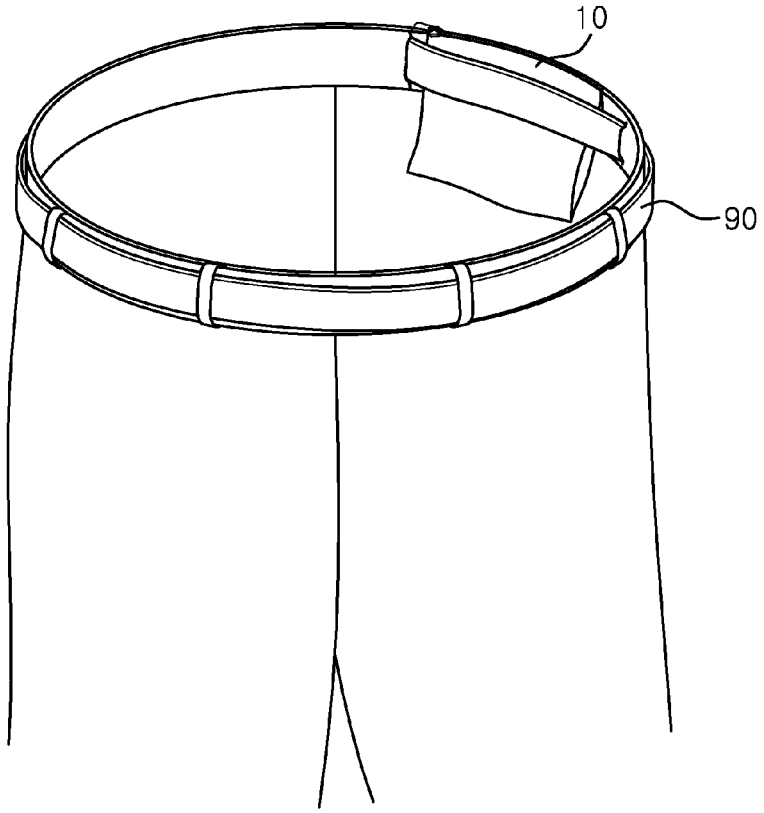
FIG. 9 shows the pocket for a garment according to an embodiment of the present invention showing the layout of a belt and the pocket.
Figure 10A:
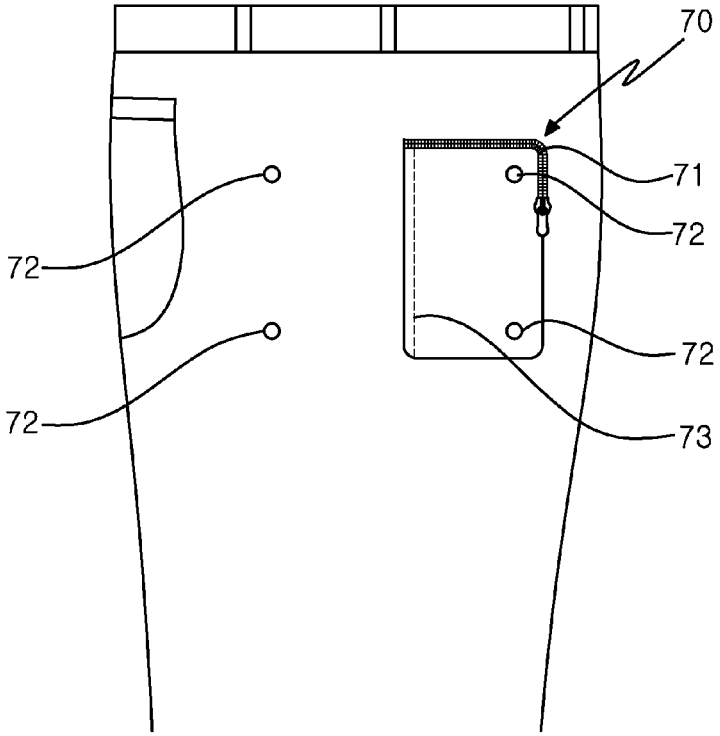
FIG. 10(*a*) shows a side view of the pocket according to still another embodiment of the present invention.
Figure 10B:
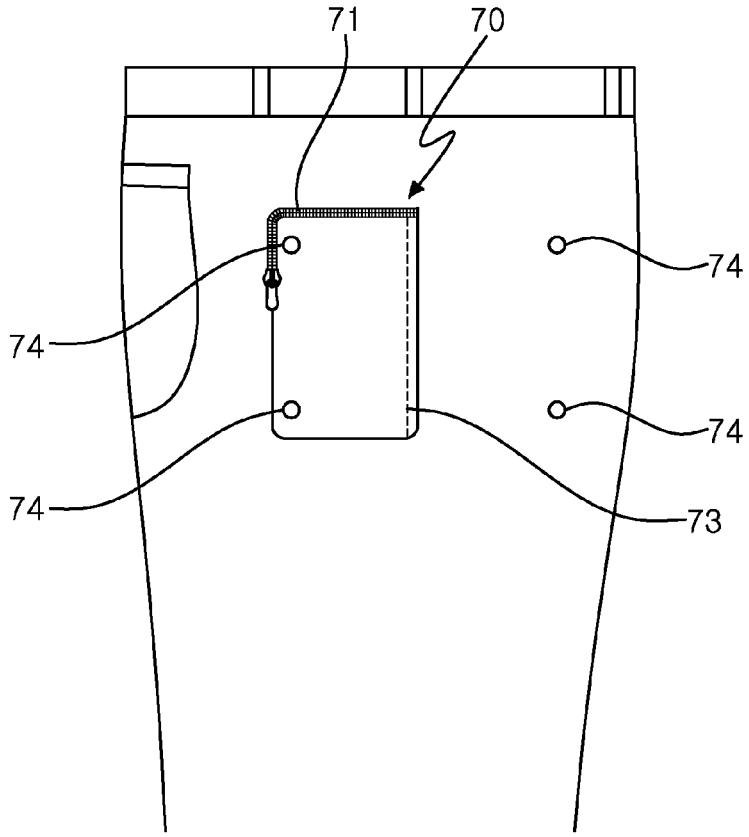
Figure 10C:
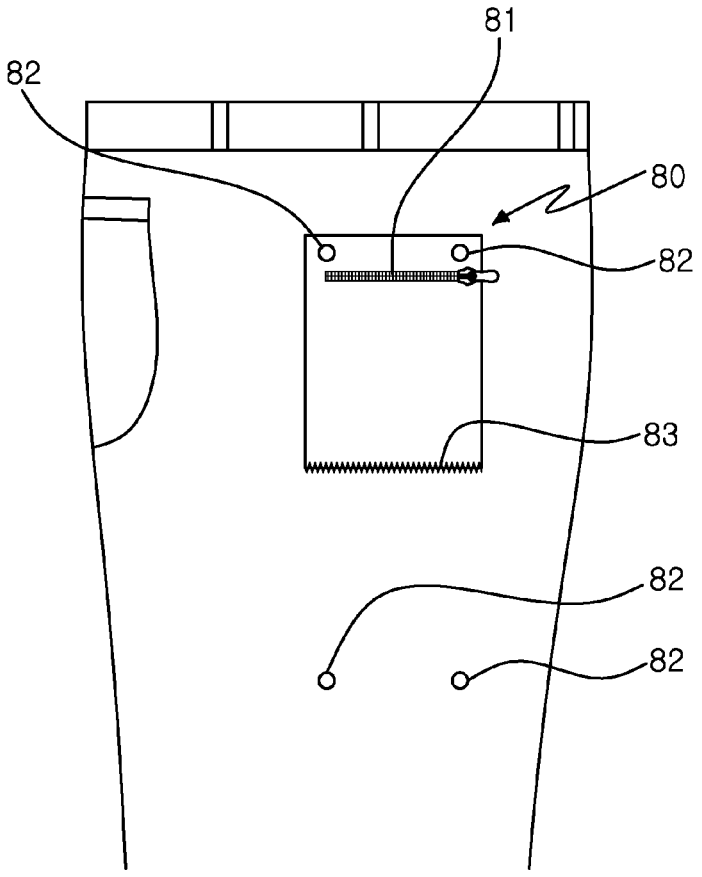
Figure 10D:
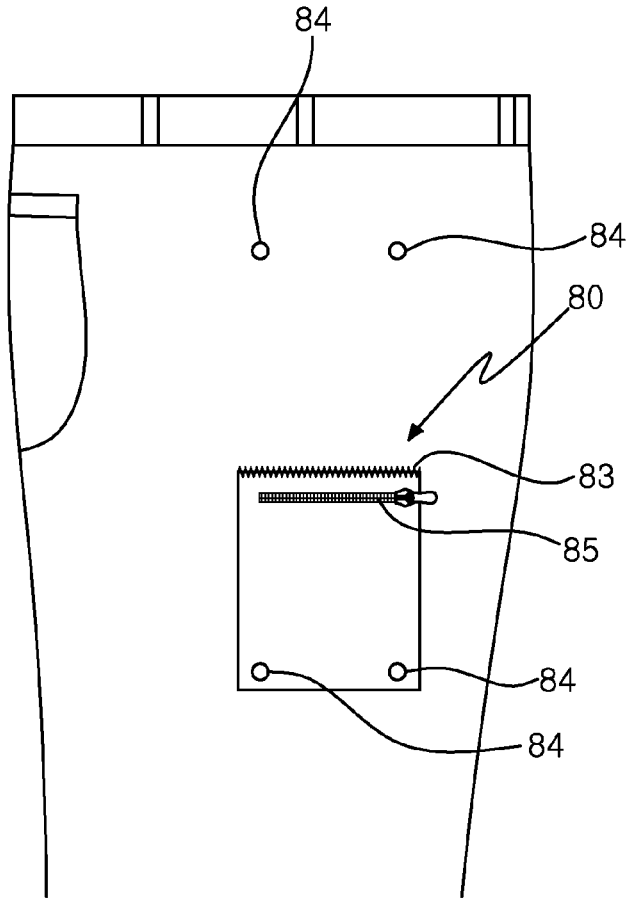

FIGS. 1(*a*) and 1(*b*) respectively show front and rear views of the pocket for a garment according to one embodiment of the present invention and FIG. 1(*c*) shows a rear view of another embodiment. FIG. 2 shows the embodiment of FIGS. 1(*a*) and 1(*b*) fixedly attached to the garment 100 such as trousers, pants, jeans, or shorts. FIGS. 3(*a*), 3(*b*), and 3(*c*) show the embodiment of FIG. 1(*c*) respectively fixedly attached to front upper edge, rear upper edge, and side upper edge of the garment 100. FIG. 3(*d*) shows the embodiments of FIG. 3(*a*) or 3(*b*) when the first pocket 20 is open. In addition, FIG. 9 shows the arrangement structure between the pocket 10 and the belt 90.

The pocket 10 for a garment 100 includes a first pocket 20 fixedly attached to the garment 100 at a predetermined location wherein a first opening is formed on the garment 100 and the first pocket 20 is fixedly attached to a rim of the first opening such that the first pocket 20 is accessible through the first opening; and a second pocket 30 fixedly attached to the first pocket 20 wherein a second opening is formed on the first pocket 20 such that the second pocket 30 is accessible through the second opening. The pocket 10 of the present invention further includes a first closure means 21 to open or close the first opening and a second closure means 31 to open or close the second opening. The second opening is accessible through the first opening which means that the second opening can be reached after the first closure means 21 is open. Furthermore, the first closure means 21 may be a zipper and the second closure means 31 may be a snap fastener as shown in FIGS. 1(*a*), 1(*b*) and 1(*c*).

The first pocket 20 is to carry items such as a cell phone, smart phone or mobile phone and the second pocket 30 is generally to carry smaller items. Preferably, the first pocket 20 is attached to the garment 100 by sewing.

A mobile phone 80 is generally longitudinal as in FIG. 1(*b*) or 1(*c*). Accordingly, the first pocket 20 may be vertically longitudinal as in FIGS. 1(*a*) and 1(*b*), or horizontally longitudinal as in FIG. 1(*c*), depending on whether the mobile phone 80 vertically or horizontally fits in the first pocket 20.

The first pocket 20 is sized to carry a mobile phone or a smart phone so that the mobile phone 80 comfortably fits in. Preferably, the first pocket 20 is located between the garment 100 and the second pocket 30 when the pocket 10 is fixedly attached to the garment 100.

In the embodiments of FIGS. 2, 3(*a*), 3(*b*), 3(*c*) and 3(*d*), the garment 100 may be pants, trousers, shorts or jeans.

In the embodiment of FIG. 2, the pocket 10 of the present invention may further include a third pocket 40 having a diagonal opening formed on the garment 100. The third pocket 40 is a convention pocket for a garment having no closure means. The first pocket 20 is preferably located at around side seam of the garment 100. As shown in FIG. 2, the first closure means 21 may intersect with a vertical side seam of the garment 100 and the diagonal opening of the third pocket 40 may intersect with the first closure means 21. The first closure means 21 is illustrated as horizontal in FIG. 2, but it may be diagonal going upward toward right for easier access to the first opening of the first pocket 20. Due to this intersection structure, the three pockets 20, 30 and 40 do not occupy much space and access to them is convenient. A user can open the zipper 21 from left to the right and then insert a mobile phone 80. The user may further open the snap fastener 31 to insert other items and still use the third pocket 40.

As in FIG. 2, the first pocket 20 may be vertically longitudinal. Alternatively, the first opening may be substantially vertically formed on the garment 100 and preferably, the first opening is formed along or substantially parallel to the vertical side seam of the garment 100.

In still another embodiment of FIG. 3(*a*), the first opening may be formed along or substantially parallel to a front upper edge of the garment 100 and the first pocket 20 may be horizontally longitudinal.

In still another embodiment of FIG. 3(*b*), the first opening is formed along or substantially parallel to a rear upper edge of the garment and the first pocket 20 is horizontally longitudinal.

In still another embodiment of FIG. 3(*c*), the first opening is formed along or substantially parallel to a side upper edge of the garment and the first pocket 20 is vertically longitudinal. The first pocket 20 may be next to the vertical side seam of the garment 100 as in FIG. 3(*c*) or right above the vertical side seam of the garment 100.

FIG. 3(*d*) shows the embodiments of FIG. 3(*a*) or 3(*b*) when the first pocket 20 is open. In these embodiments, the first pocket 20 is formed outside of the garment 100 and the second pocket 30 is formed inside the garment 100. The dividing fabric between the first and second pockets 20 and 30 is part of the garment 100. In other words, the first pocket 20 is formed by fixedly attaching a layer of fabric on the outside of the garment 100 and the second pocket 30 is formed by fixedly attaching another layer of fabric on the inside of the garment 100. The pockets 20 and 30 may be formed on the front upper edge of a garment 100 as in FIG. 3(*d*), or on the rear upper edge of a garment 100.

FIG. 9 shows the arrangement structure between the pocket 10 and the belt 90. Belt holes are formed on the garment 100 so that the belt 90 passes through the belt holes to bypass the pocket 10. Thus, the pocket 10 is located outside the belt 90.

Figure 4A:
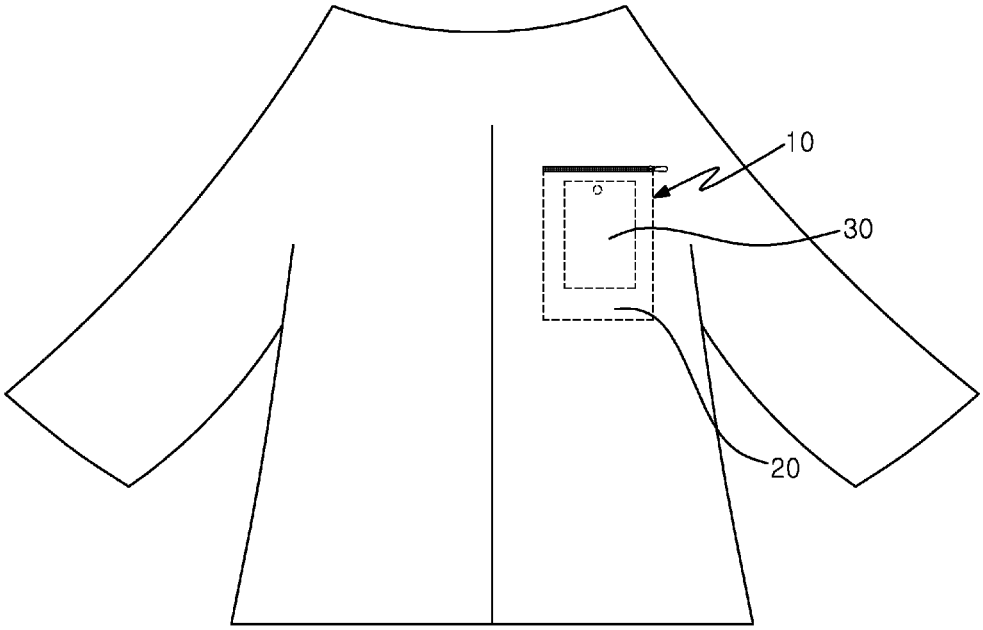
FIG. 4(*a*) shows the pocket of FIG. 1(*a*) fixedly attached to a garment such as a shirt.
Figure 4B:
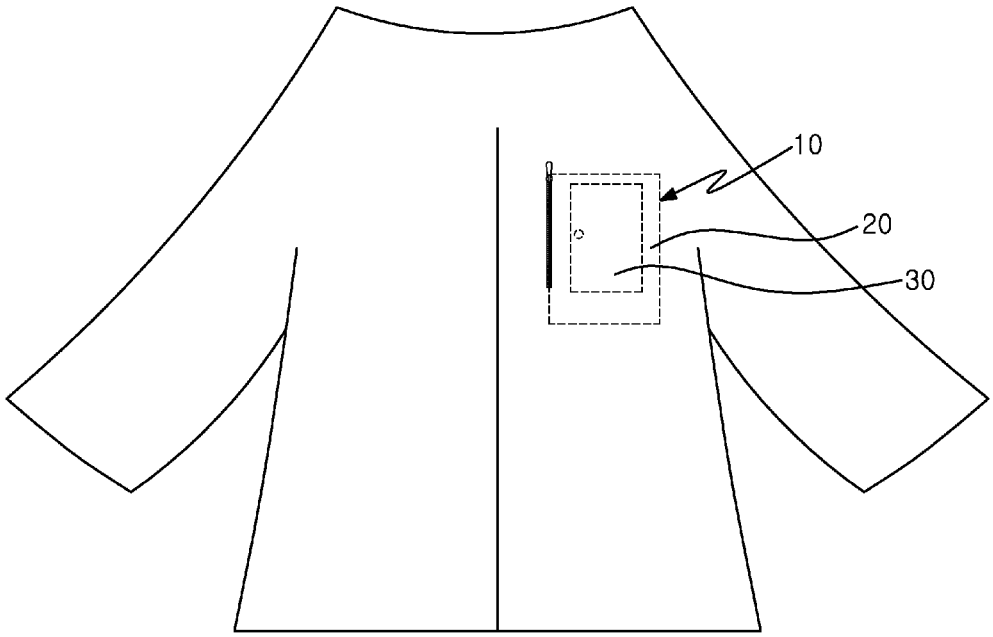

FIGS. 4(*a*) and 4(*b*) show the pocket 10 of the present invention formed on a garment 100 such as a shirt or a jacket. The first opening of the first pocket 20 is formed substantially horizontally on or about a chest part of the garment and the first pocket 20 is vertically longitudinal. Alternatively, the first opening of the first pocket 20 is formed substantially vertically on or about a chest part of the garment and the first pocket 20 is still vertically longitudinal.

Figure 5:
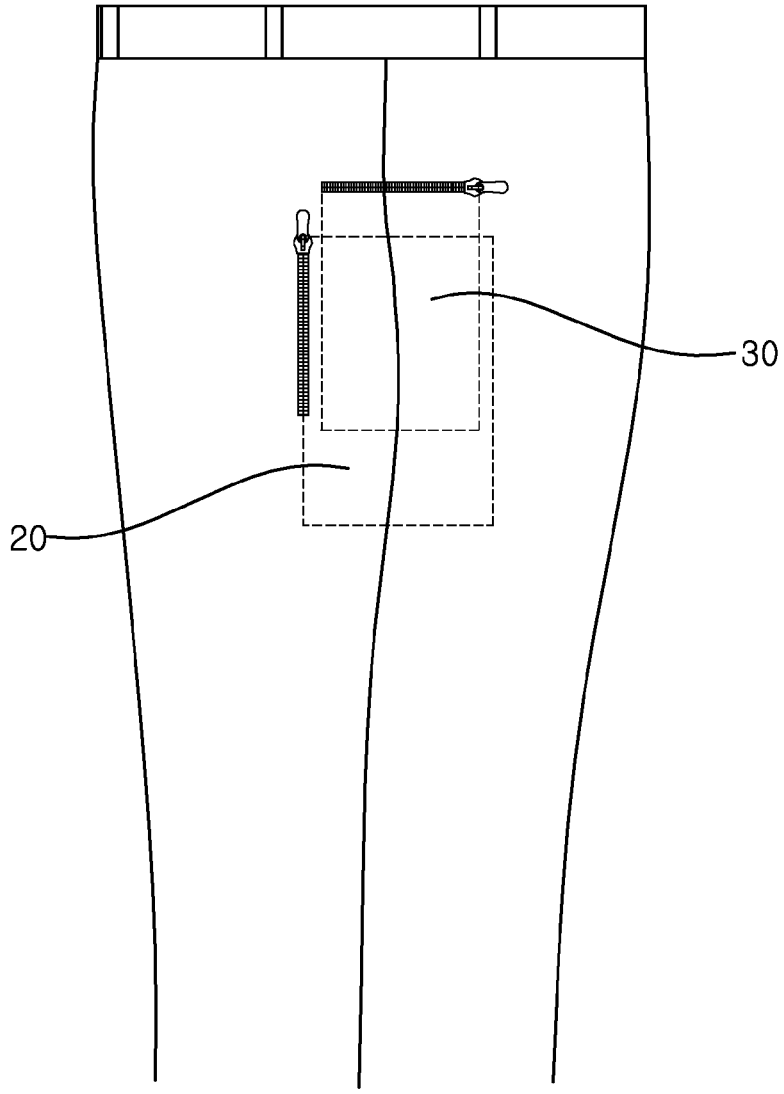
FIG. 5 shows pockets for a garment fixedly attached to a garment such as pants, trousers or jeans according to still another embodiment of the present invention.

FIG. 5 shows pockets for a garment fixedly attached to a garment such as pants, trousers or jeans according to still another embodiment of the present invention. The pocket 10 for a garment 100 comprises a first pocket 20, fixedly attached to the garment 100 at a first predetermined location, having a first opening wherein the first pocket 20 is accessible through the first opening; and a second pocket 30, fixedly attached to the garment 100 at a second predetermined location, having a second opening wherein the second pocket 30 is accessible through the second opening. The pocket 10 further includes a first closure means 21 to open or close the first opening; and a second closure means 31 to open or close the second opening.

The first pocket 20 is formed by sewing a first fabric to the garment 100 along the first fabric's edges to the garment 100, and the second pocket 30 is formed by sewing a second fabric to the garment 100 along the second fabric's edges to the garment 100. Preferably, the first and second closure means 21 and 31 are zippers, and the first opening is formed vertically whereas the second opening is formed horizontally.

The first pocket 20 is sized to carry a mobile phone or a smart phone and vertically longitudinal. The first and the second pockets 20 and 30 share same portion of the garment 100. The first fabric is sewn to the garment to form the first pocket 20 on the inner side of the garment 100 and the second fabric is sewn to the garment to form the second pocket 30 on the outer side of the garment 100. Alternatively, the first and second pockets 20 and 30 may be respectively formed on outer and inner sides of the garment 100.

In still another embodiment of the present invention, the first pocket 20 may be formed by sewing a first fabric to the garment 100 along the first fabric's edges to the garment, and the second pocket 30 may be formed by sewing a second fabric to the garment 100 along the second fabric's edges to the garment. The first closure means 21 is a zipper and the second closure means 31 is a snap fastener.

The first opening is formed along a rear upper edge of the garment and the second opening is accessible through the first opening. The first and the second pockets 20 and 30 share same portion of the garment 100. The first pocket 20 is sized to carry a mobile phone or a smart phone and the first pocket 20 is horizontally longitudinal. The first pocket 20 is formed on outer side of the garment and the second pocket 30 is formed on inner side of the garment.

Figure 6A:
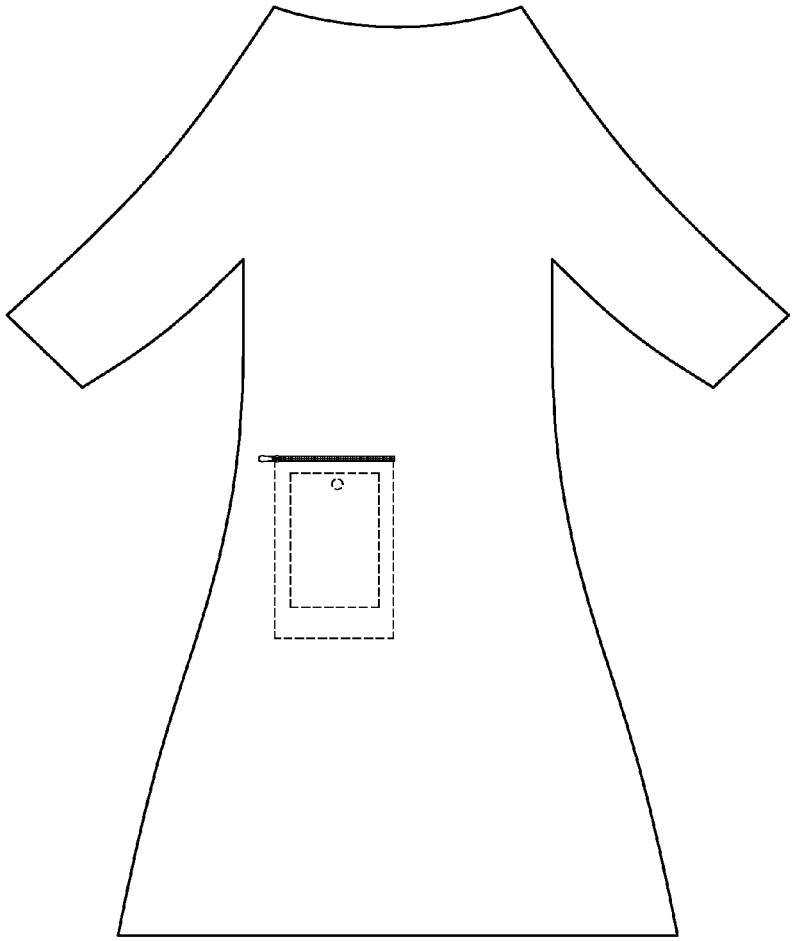
FIG. 6(*a*) shows the pocket for a garment of FIG. 1(*a*) fixedly attached to a garment such as a dress.
Figure 6B:
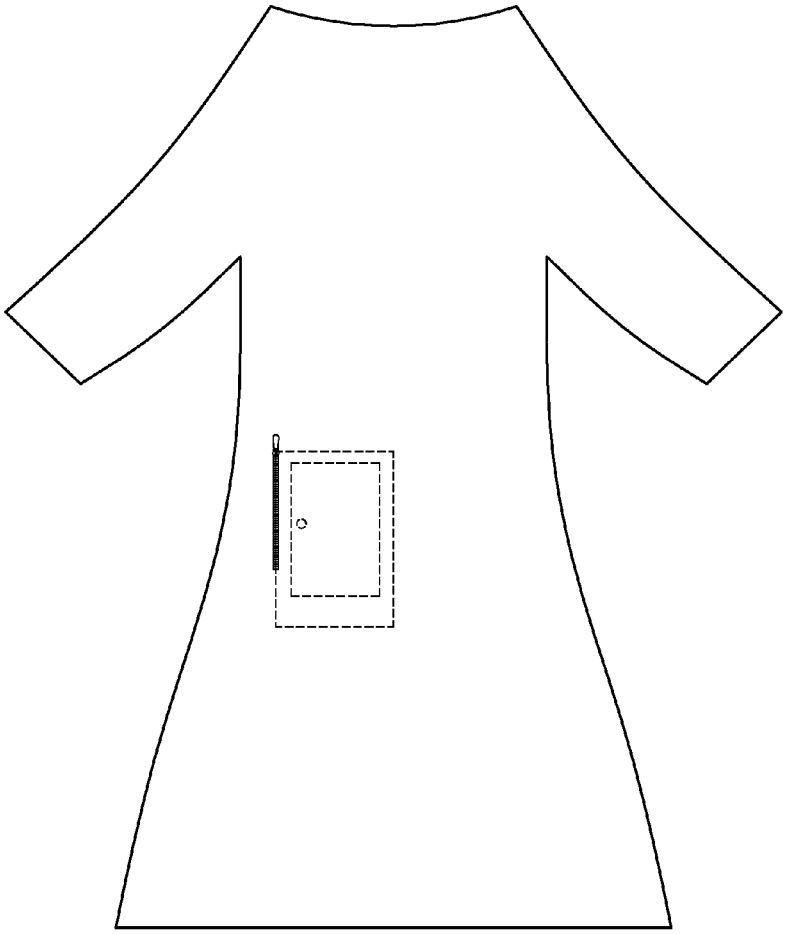
Figure 6C:
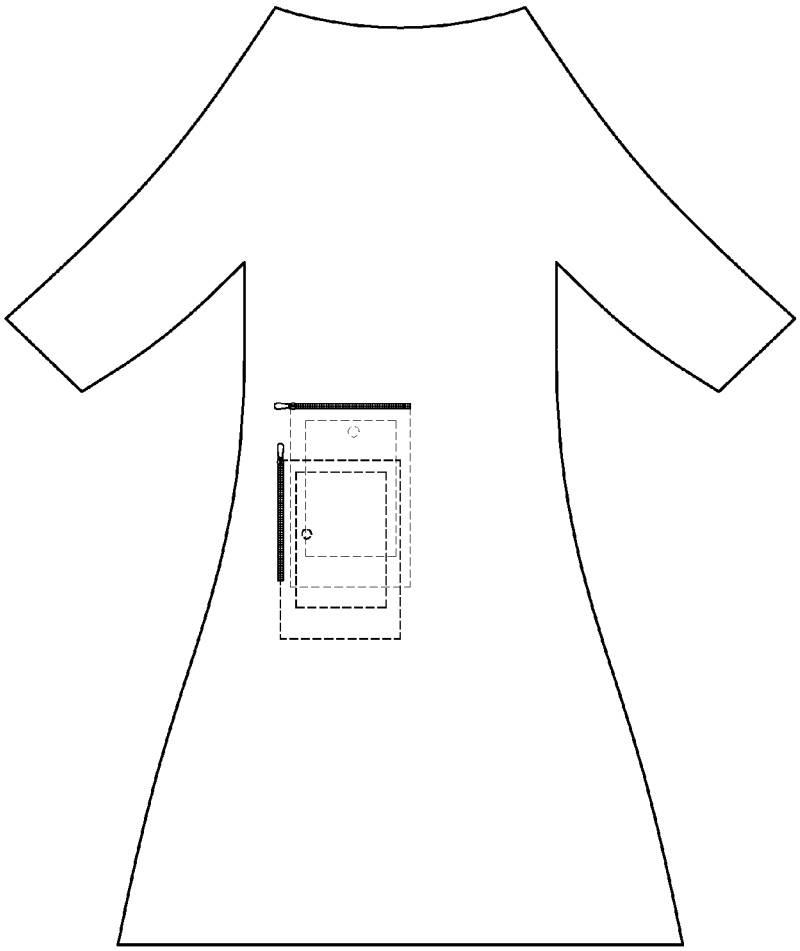

FIG. 6(*a*) shows the pocket 10 for a garment 100 of FIG. 1(*a*) fixedly attached to a garment 100 such as a dress. FIG. 6(*b*) shows another embodiment of the pocket 10 fixedly attached to the garment 100 and FIG. 6(*c*) shows still another embodiment of the pocket 10 fixedly attached to the garment 100. In FIG. 6(*a*), the first pocket 20 is vertically longitudinal and the first closure means 21 is a zipper horizontally affixed to the garment 100 by sewing. In FIG. 6(*b*), the first pocket 20 is still vertically longitudinal. However, the first closure means 21 is vertically affixed to the garment 100. In FIG. 6(*c*), the pocket 10 comprises first and second pockets 20 and 30 just like that in FIG. 5. The first and second pockets 20 and 30 share same portion of the garment 100, one formed inside of the garment 100 and the other outside.

Figure 7A:
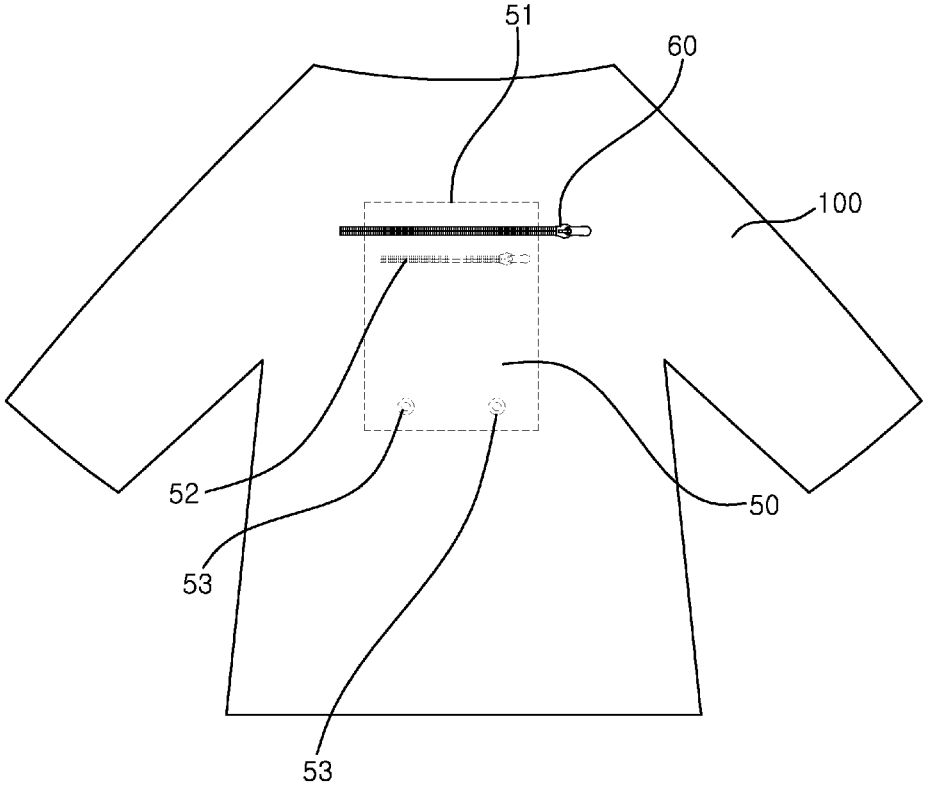
FIG. 7(*a*) shows a backpack for a garment attached to a back of garment such as a shirt or jacket.
Figure 7B:
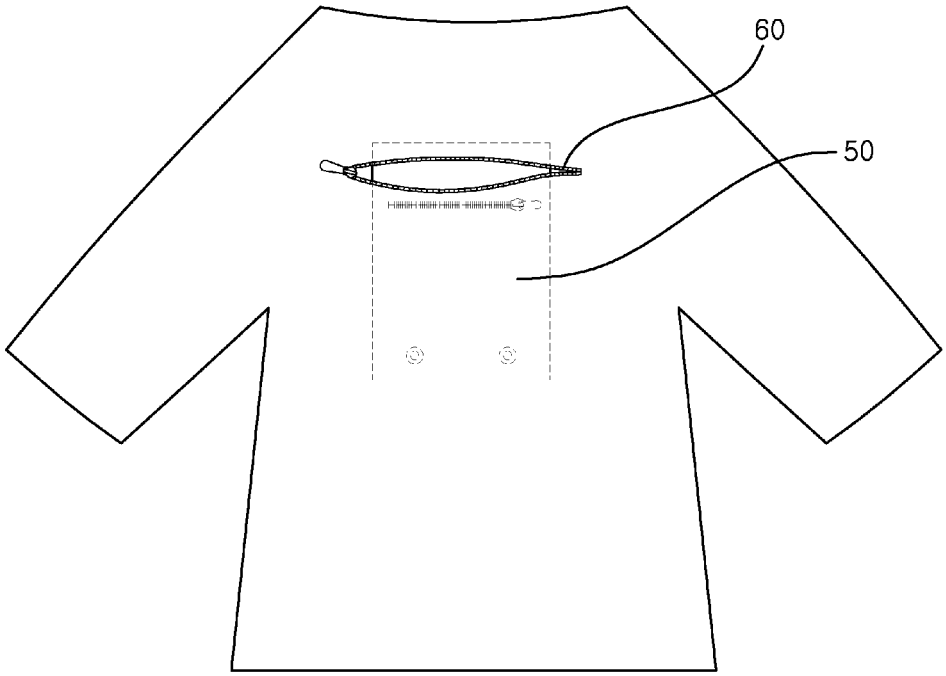
Figure 7C:
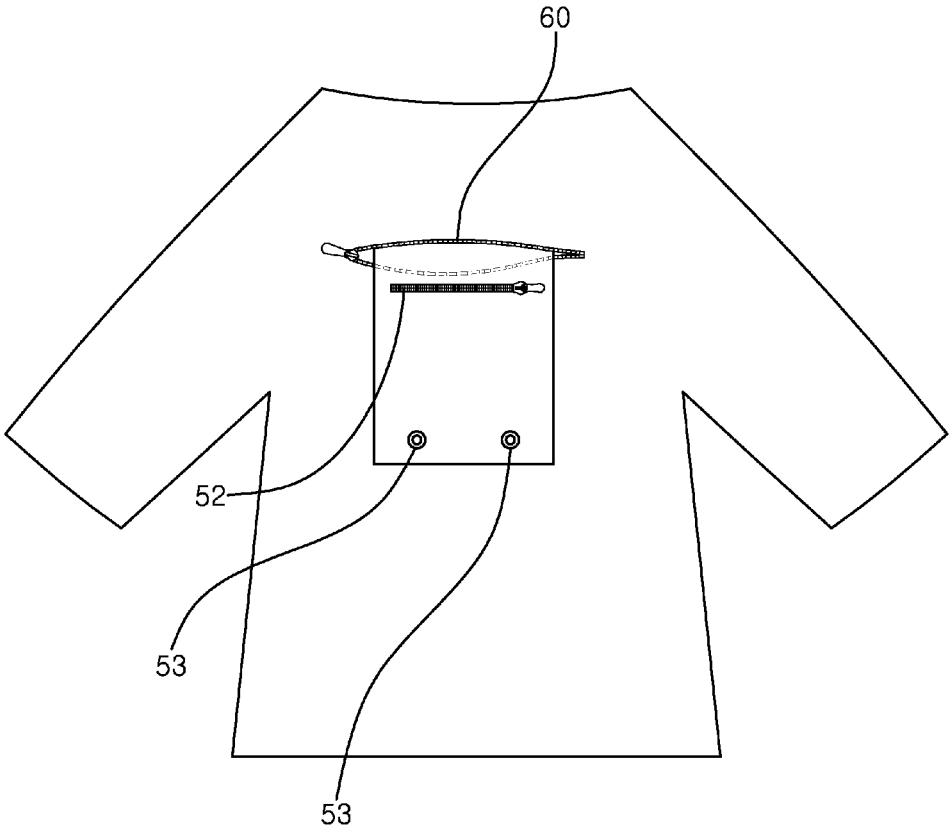

FIG. 7(*a*) shows a backpack 50 for a garment 100 attached to a back of garment 100 such as a shirt or jacket. FIG. 7(*b*) shows the backpack 50 for a garment 100 where the garment opening means 60 is open and FIG. 7(*c*) shows the backpack 50 for a garment 100 where the backpack 50 is pulled out through the garment opening means 60.

The backpack 50 for a garment 100 of the present invention comprises a garment opening means 60 formed on a back of the garment 100 to open or close a garment opening; and a backpack 50 attached to an inner side of the back of the garment 100 by a backpack attachment means 51. The backpack 50 further comprises a backpack opening means 52 to open or close the backpack and the backpack 50 is configured to be able to be pulled out through the garment opening after the garment opening means 60 is open.

The backpack attachment means 51 may be sewing or a zipper. In addition, the garment opening means 60 and the backpack opening means 52 may be zippers.

Figure 8A:
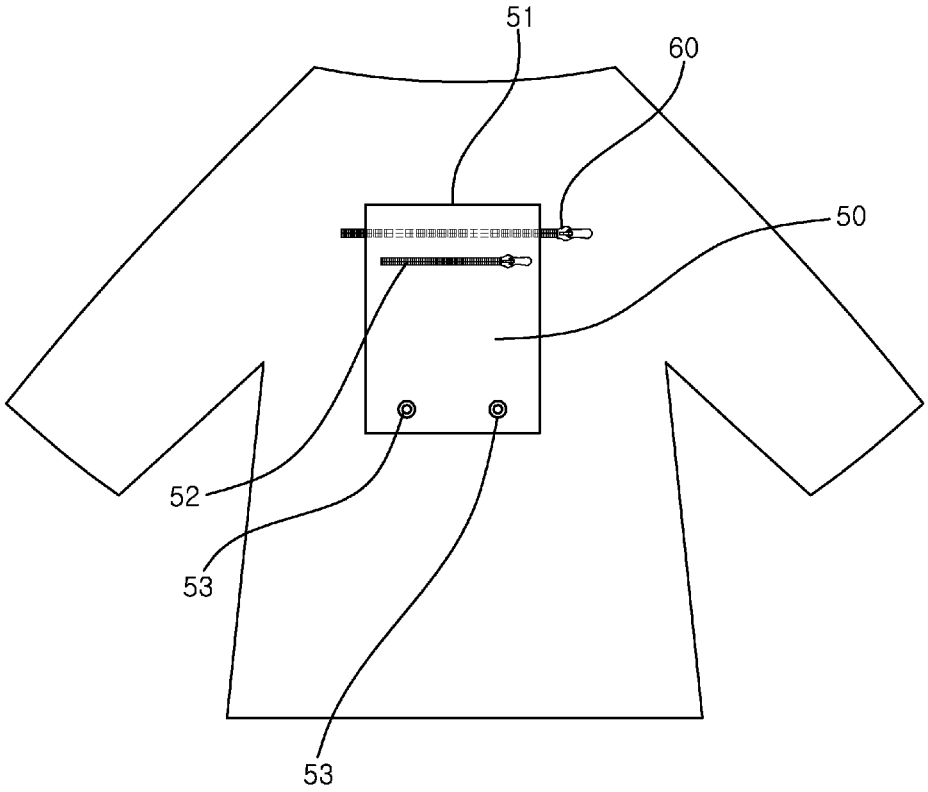
FIG. 8(*a*) shows another embodiment of a backpack for a garment.
Figure 8B:
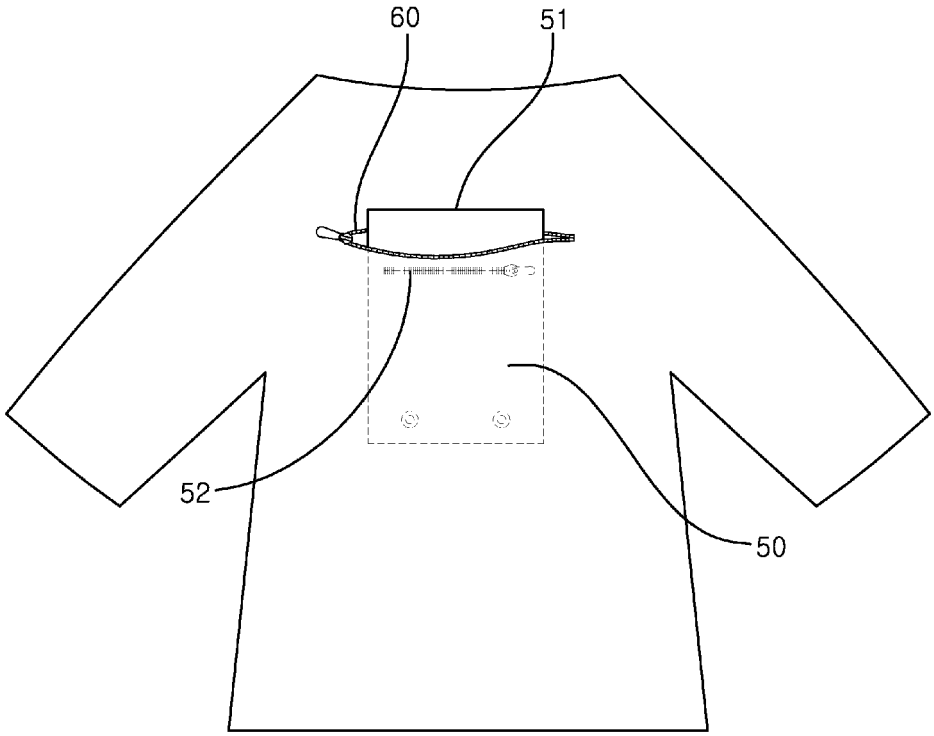

FIG. 8(*a*) shows another embodiment of a backpack 50 for a garment 100 and FIG. 8(*b*) shows the backpack 50 for a garment 100 where the backpack is put inside through the garment opening means 60.

The backpack 50 is attached to a back of the garment by an upper attachment means 51 such as sewing or a zipper and a lower attachment means 53 such as snap fastener(s). The backpack 50 further includes a backpack opening means 52 such as a zipper to open or close the backpack 50.

The garment opening means 60 such as a zipper is formed on the back of the garment 100 and after the garment opening means 60 is open, the backpack 50 can be put into the garment 100 as shown in FIG. 8(*b*).

FIG. 10(*a*) shows another embodiment of the present invention and FIG. 10(*b*) shows the pocket 70 when it is flipped to the left. The opening means 71 for the pocket 70 is preferably a zipper and the pocket 70 is attached to the garment by sewing 73. By the attachment means 72, the pocket 70 can be attached to the right as in FIG. 10(*a*) or to the left as in FIG. 10(*b*). The attachment means 72 is snap fasteners.

FIGS. 10(*c*) and 10(*d*) show still another embodiment of the present invention. Unlike the embodiment of FIGS. 10(*a*) and 10(*b*), the pocket 80 can be attached to the upper side or to the lower side by using the attachment means 82 and 84 such as snap fasteners. The pocket 80 is fixed to the garment by sewing 83. The opening means 81 and 85 are zippers.

Figure 11A:
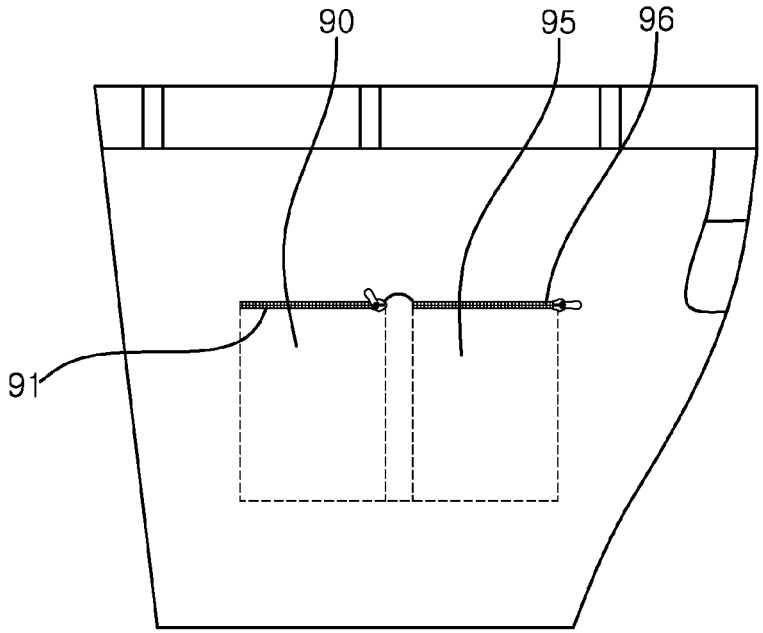
FIG. 11(*a*) shows a side view of the pocket according to still another embodiment of the present invention.
Figure 11B:
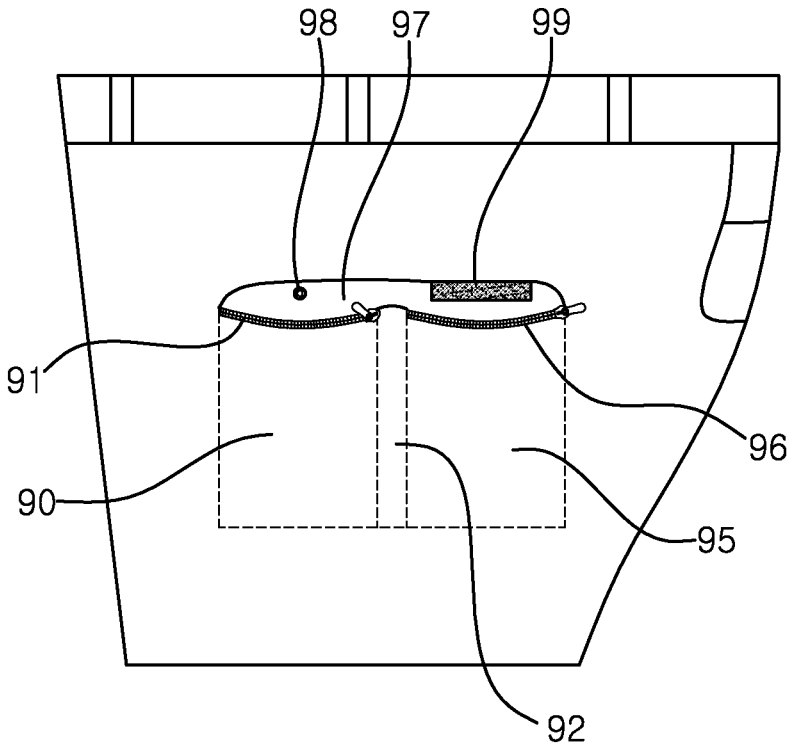

FIGS. 11(*a*) and 11(*b*) show still another embodiment of the present invention. The pocket comprises a first pocket 90, a second pocket 95 and a third pocket 97. The opening means 91 and 96 for the first and second pockets 90 and 95 are zippers. A hook and loop fastener 92 is formed in the boundary between the first and second pockets 90 and 95 such that the first and second pockets can be connected once the hook and loop fastener 92 is open. Outer fabric layer of the first and second pockets 90 and 95 is the garment itself. The third pocket 97 is formed inner side of the first and second pockets 90 and 95 and the opening means for the third pocket 97 is a snap fastener 98 and a hook and loop fastener 99.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A pocket for a garment, comprising:

a first pocket fixedly attached to the garment at a predetermined location wherein a first opening is formed on the garment and the first pocket is fixedly attached to a rim of the first opening such that the first pocket is accessible through the first opening;

a first closure means to open or close the first opening;

a second pocket fixedly attached to the first pocket wherein a second opening is formed on the first pocket and such that the second pocket is accessible through the second opening;

a second closure means to open or close the second opening, wherein the second opening is accessible through the first opening; and a third pocket having a diagonal opening formed on the garment, wherein the diagonal opening does not have a closure means and the diagonal opening intersects with the first closure means, wherein the first closure means is a zipper and the second closure means is a snap fastener, wherein the first pocket is sized to carry a mobile phone or a smart phone and the first pocket is located between the garment and the second pocket, wherein the garment is pants, trousers, shorts or jeans.

2. The pocket for a garment of claim 1, wherein the first closure means intersects with a vertical side seam of the garment.

3. The pocket for a garment of claim 1, wherein the first opening is substantially vertically formed on the garment.

4. The pocket for a garment of claim 3, wherein the first opening is formed along or substantially parallel to a vertical side seam of the garment.

5. The pocket for a garment of claim 1, wherein the first opening is formed along or substantially parallel to a front upper edge of the garment.

6. The pocket for a garment of claim 1, wherein the first opening is formed along or substantially parallel to a rear upper edge of the garment.

7. The pocket for a garment of claim 1, wherein the first opening is formed along or substantially parallel to a side upper edge of the garment.

8. The pocket for a garment of claim 1, wherein the garment is a shirt or a jacket.

9. The pocket for a garment of claim 8, wherein the first opening is formed substantially horizontally on or about a chest part of the garment.

10. The pocket for a garment of claim 8, wherein the first opening is formed substantially vertically on or about a chest part of the garment.

* * * * *